US005688421A

United States Patent [19]

Walton

[11] Patent Number: 5,688,421

[45] Date of Patent: Nov. 18, 1997

[54] DISPENSER FOR HEAT-LIQUEFIABLE MATERIAL WITH CONTIGUOUS PTC HEATER AND HEAT EXCHANGING MEMBER

[76] Inventor: William M. Walton, 6564 Thomas Pkwy., Rockford, Ill. 61111

[21] Appl. No.: 605,686

[22] Filed: Feb. 22, 1996

Related U.S. Application Data

[63] Continuation of Ser. No. 125,548, Sep. 23, 1993, abandoned, which is a continuation-in-part of Ser. No. 774,802, Oct. 11, 1991, abandoned.

[51] Int. Cl.[6] ..... H05B 1/00

[52] U.S. Cl. ..... 219/230; 219/241; 219/425; 222/146.5

[58] Field of Search ..... 219/230, 227, 219/228, 420–425, 543, 235, 240, 241, 541; 222/146.1, 146.2, 146.5

[56] References Cited

U.S. PATENT DOCUMENTS

| | | | |
|---|---|---|---|
| 475,442 | 5/1892 | Cuttriss | 219/421 X |
| 1,109,034 | 9/1914 | Bryan | 401/2 |
| 1,129,900 | 3/1915 | Proctor et al. | 401/2 |
| 1,449,517 | 3/1923 | Lame | 401/2 |
| 3,092,704 | 6/1963 | Dewoody et al. | 219/541 X |
| 3,298,572 | 1/1967 | Newton | 219/227 X |
| 3,302,833 | 2/1967 | Leika | 222/146.1 |
| 3,377,012 | 4/1968 | Cushman | 222/146.5 |
| 3,430,816 | 3/1969 | Nadherny et al. | 401/1 X |
| 3,443,059 | 5/1969 | Spencer | 219/233 |
| 3,776,426 | 12/1973 | Newton | 222/146.5 |
| 3,818,930 | 6/1974 | Crum et al. | 222/146.5 |
| 4,050,890 | 9/1977 | Elliott et al. | 222/146.5 |
| 4,059,204 | 11/1977 | Duncan et al. | 222/146.5 |
| 4,493,972 | 1/1985 | Steinel et al. | 219/230 |
| 4,546,235 | 10/1985 | Kolter | 219/230 |
| 4,553,935 | 11/1985 | Ueno | 222/146.5 |
| 4,561,569 | 12/1985 | Dziki | 222/146.5 |
| 4,644,140 | 2/1987 | Hillinger | 219/530 |
| 4,826,049 | 5/1989 | Speer | 222/146.5 |
| 4,948,944 | 8/1990 | Oster | 219/227 |
| 5,236,269 | 8/1993 | Handy | 401/1 |
| 5,362,164 | 11/1994 | Wingert | 401/2 |
| 5,462,206 | 10/1995 | Kwasie | 222/146.5 |

FOREIGN PATENT DOCUMENTS

| | | | |
|---|---|---|---|
| 76735 | 4/1983 | European Pat. Off. . | |
| 147627 | 7/1985 | European Pat. Off. . | |
| 385235 | 9/1990 | European Pat. Off. . | |
| 914405 | 10/1946 | France | 219/230 |
| 2565131 | 12/1985 | France | 219/230 |
| 2595061 | 9/1987 | France . | |
| 3100834 | 8/1982 | Germany . | |
| 3401725 | 8/1985 | Germany | 219/230 |
| 87126 | 3/1956 | Norway | 219/230 |
| 1164446 | 9/1969 | United Kingdom | 219/230 |
| 2028687 | 8/1978 | United Kingdom . | |
| 2059513 | 4/1981 | United Kingdom . | |

*Primary Examiner*—Teresa J. Walberg
*Assistant Examiner*—Raphael Valencia

[57] ABSTRACT

A low wattage device for heat-liquefying material is described which employs a low volume mass electrical heat exchanger structure to generate a high power density within a dispensing tip; and simultaneously by actuation of an operator controlled momentary on/off switch for energizing the heat exchanger structure heater, the heat-liquefiable material is pressed into effective contact with the heat exchanger structure. The heat exchanger structure is formed by positioning a resistive heating element in contiguous relation to the outer wall of a low volume thermal conducting mass formed into a heat-liquefying material conductor and generates sufficiently high heat at a relatively low wattage to effectively achieve the desired melting within a few seconds. In a further feature, an insulating shield partially envelopes the heat exchanger structure to prevent contact with the resistive heating element and to minimize heat loss.

6 Claims, 4 Drawing Sheets

FIG. 2
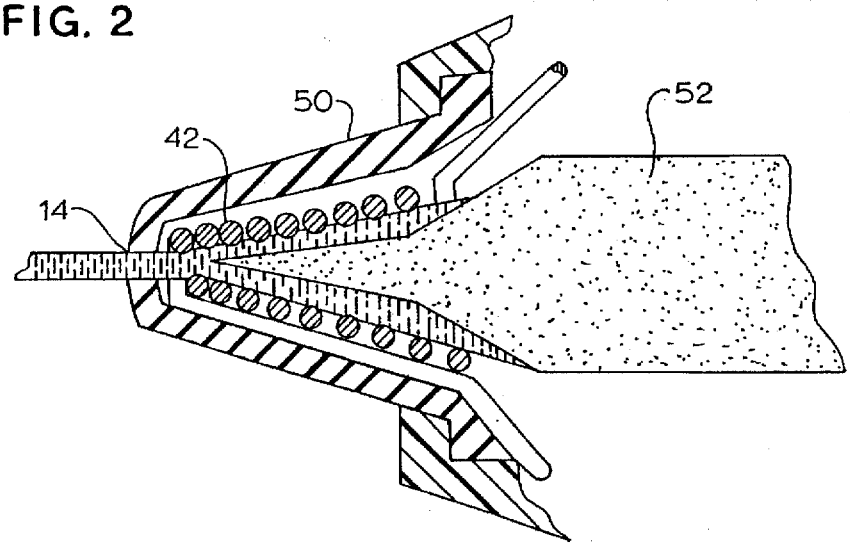
FIG. 3
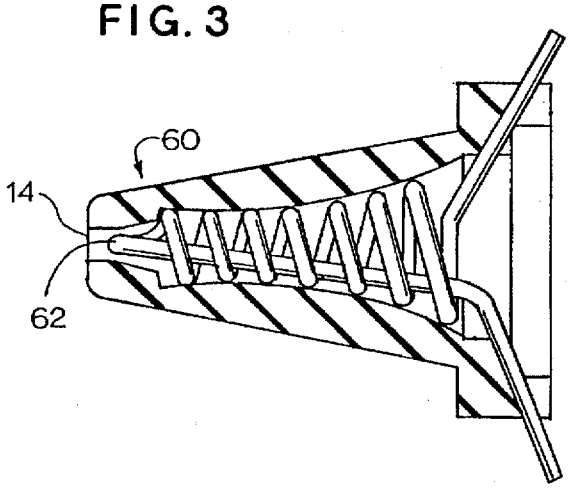
FIG. 4a
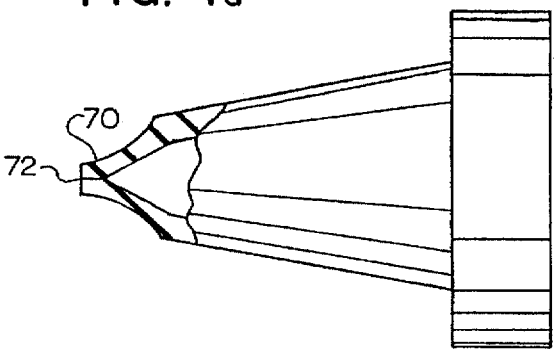
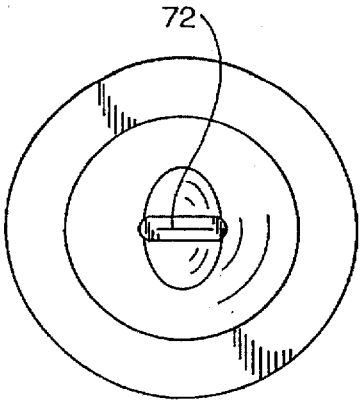
FIG. 4b

DISPENSER FOR HEAT-LIQUEFIABLE MATERIAL WITH CONTIGUOUS PTC HEATER AND HEAT EXCHANGING MEMBER

This application is a continuation of U.S. patent application Ser. No. 08/125,548, filed Sep. 23, 1993, abandoned, which is a continuation-in-part of U.S. patent application Ser. No. 07/774,802, filed Oct. 11, 1991, abandoned.

BACKGROUND OF THE INVENTION

1. Field of the Invention

The present invention relates generally to dispensers for heat-liquefiable material, and more particularly to dispensers of adhesive (glue guns). And specificially this invention relates to energy efficiency improvements in the heating element and dispensing tip structure of such devices in order to facilitate use in a fast response heat activated adhesive dispenser for either a battery powered portable appliance or a standard power-line outlet powered appliance.

2. Description of the Prior Art

Dispensers for heat-liquefiable materials, such as adhesives, have typically operated from standard power-line outlets, and due to their large thermal mass construction requiring a long warm-up period with continuous power consumption, it is apparent that the creators of these devices have not recognized energy efficient innovations that allow creation of either a fast response portable or a fast response standard power-line device. Examples of typical continuous power-line connected devices devices are described in U.S. Pat. No. 4,546,235 and U.S. Pat. No. 3,612,357. One form of cordless version is shown in U.S. Pat. No. 4,826,049: a stand is used to support a glue gun and to make an electrical contact between the gun and a power outlet. While on the stand a traditional heating dement within the gun is energized for several minutes and transfers heat to a dispensing tip comprising an extra large volume thermal mass. This heat exchanger structure (thermal mass) then supplies the necessary heat while the gun is off the stand to melt and dispense the adhesive. In that device, as is the case generally with prior glue guns, a heating element in combination with a large volume thermal mass requires significant electrical energy and a long time delay for heat-up to the heat liquefication temperature.

Another cordless version limited to battery or low-voltage operation is shown in French Patent No. 2565131. The unit does have a fast heat response, but, because the heating element directly contacts the adhesive, safety considerations preclude its use in higher power-line voltage designs due to potential insulation failure that may result in electrical conductance thru the adhesive media.

SUMMARY OF THE INVENTION

Accordingly, it is the principal objective of the present invention to provide a rapid on/off adhesive melting response glue gun which is energy efficient and is operable on either battery power as a portable appliance or from an electrical power-line outlet. Moreover, it is also an objective to provide in such a device a heat exchanger structure which responds quickly to applied power and warms the adhesive to its liquefication temperature in less than one minute. A manually operated bigger incorporated into the glue gun supplies power to a resistive heating element located on the outer wall of the heat exchanger structure by closing an electrical switch simultaneously with application of mechanical force to the adhesive feeding mechanism. An additional objective is to provide an insulating protective means around the dispensing nozzle and heating source.

The above objectives are accomplished in the preferred embodiment of the present invention by employing an efficient low volume thermal transfer mass in the form of an adhesive conductor and an electrical resistive heat exchanger structure which provides a high power density per unit volume; and when the operator pulls the glue gun trigger, the heat liquefiable material is pressed into effective contact with the heating element structure which is simultaneously energized by an on/off power switch actuated by the trigger. The heat exchanger structure is formed by mounting a discrete resistive material configuration in contiguous relation to the outer wall of a formed low volume thermal mass adhesive conductor to generate and rapidly transfer sufficiently high heat thru the conductor wall in order to achieve the desired melting with minimal energy expended. In a further feature, a silicon rubber tip envelopes the tip of the heating element structure to prevent contact and minimize heat loss.

BRIEF DESCRIPTION OF DRAWINGS

FIGS. 1–4*b* of the accompanying drawings illustrate an embodiment of a glue gun device or the like described in prior U.S. patent application Ser. No. 07/774,802.

FIG. 1 is a cross sectional view of a glue gun device or the like for dispensing heat-liquefied material.

FIG. 2 is a cross sectional view of the heating element and dispensing tip of the device of FIG. 1.

FIG. 3 is a cross sectional view of an alternative embodiment of the dispensing tip of FIG. 1, with an alternative embodiment of the heating element shown in perspective.

FIG. 4*a* is a perspective view partially cut away, of an alternative embodiment of a dispensing tip.

FIG. 4*b* is an end view of the dispensing tip of FIG. 4*a*.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
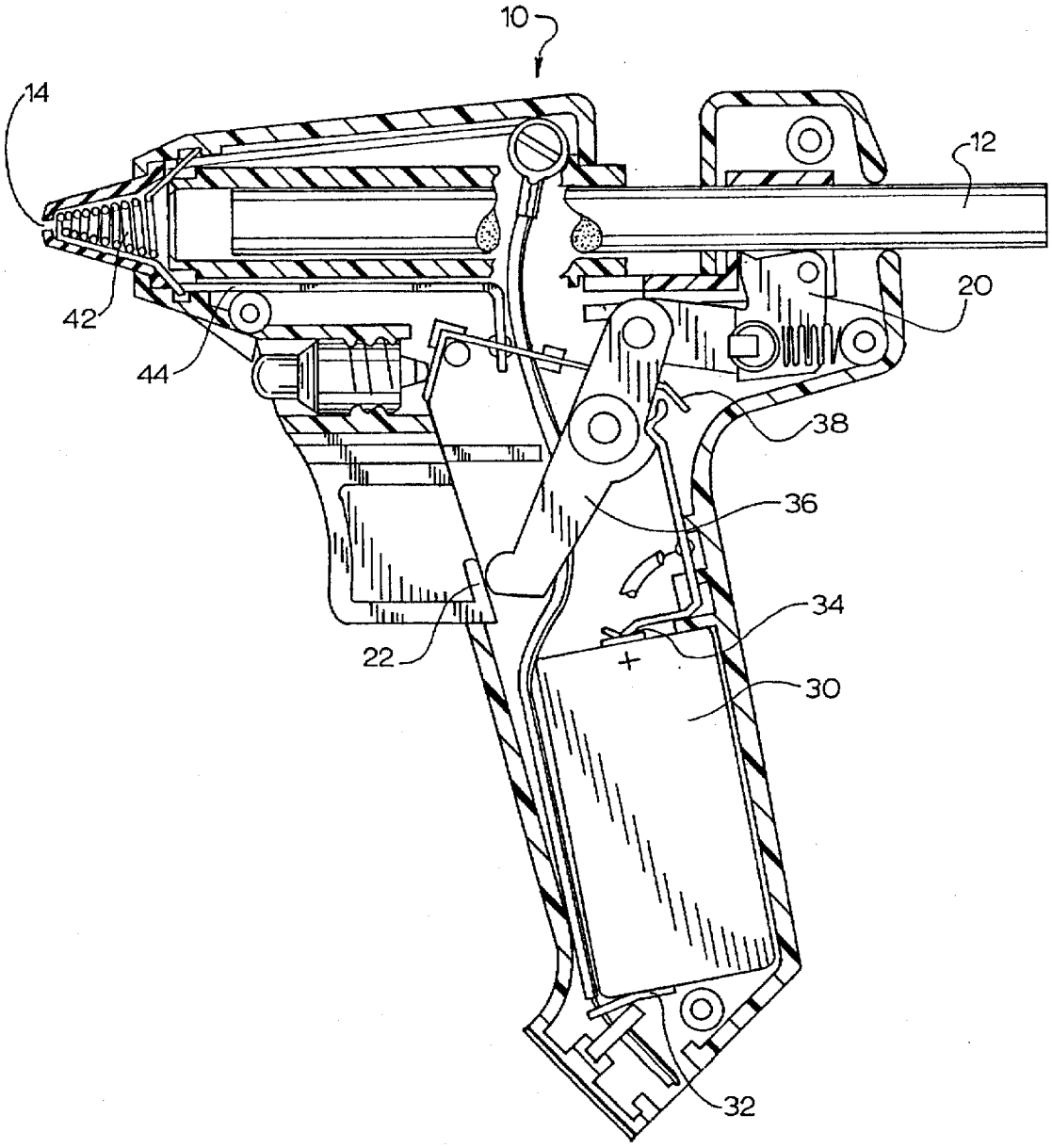
Figure 5:
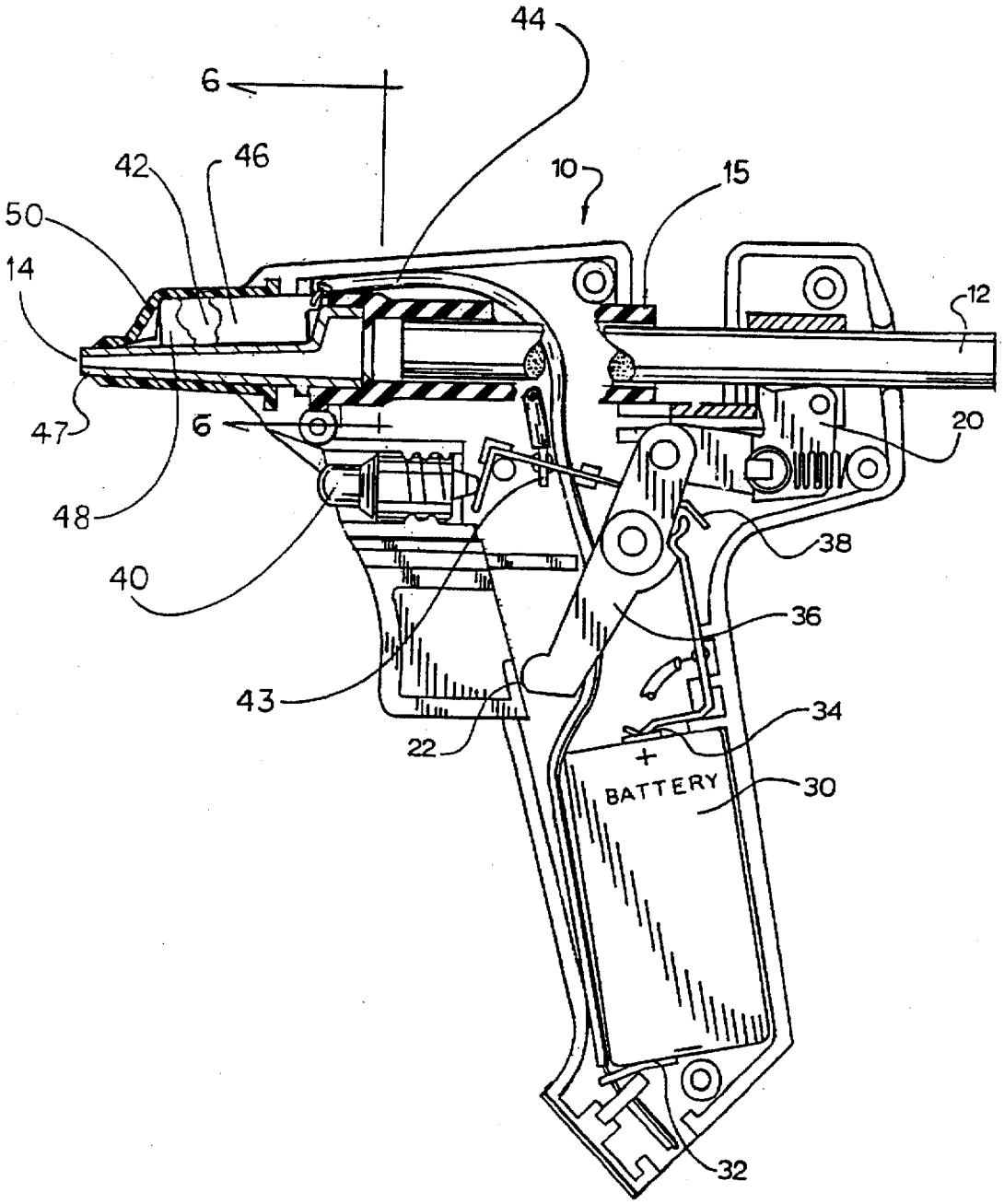
FIG. 5 is a cross sectional view of a glue gun device or the like for dispensing heat-liquefied material that employs the improved heat exchanger structure of the present invention along with a simultaneously actuated electrical switch and adhesive feeding mechanisim.

Turning now to the drawings, FIG. 5 depicts, in cross section, a device for applying heat to liquefy solid material, such as an adhesive, fed therein. This device 10 is adapted to receive sticks of solid material 12 through guide tube 15 and to eject liquefied material from the outlet 14. The solid material 12 is fed into the device by a rachet mechanisim 20 actuated by a trigger 22, all in a manner and employing apparatus well known in the art.

Figure 6:
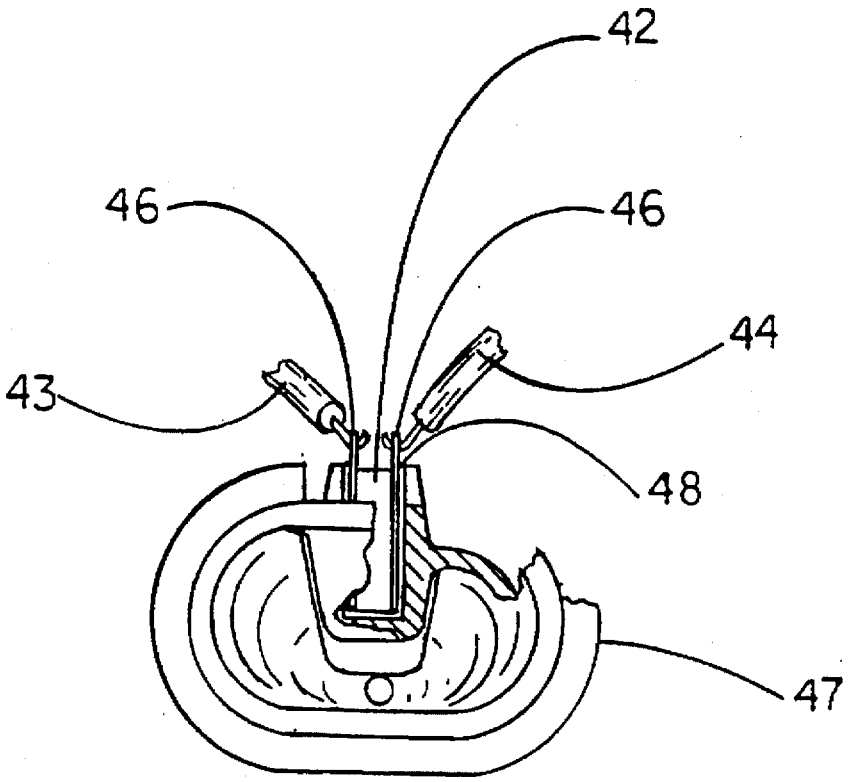
FIG. 6 is an enlarged, partially sectioned, end view 6—6 of FIG. 5 showing the formed heat-liquefiable material conductor and resistive heating element placement.

As a result of the innovative design of the heating and dispensing features of the present invention, this device is effectively and efficiently powered by a battery 30 having a ground connection 32 and a positive terminal 34. (It should be appreciated that while a battery source is illustrated, the innovations of the present invention will function well with any power-line source.) When operated, the retracting trigger 22 pivots lever 36 to feed the solid stick 12. Additionally, such actuating movement of the lever 36 simultaneously causes closure of switch connection 38. This directs power to an indicator lamp 40 as well as to the heating element 42 thru contact plates 46 via wires 43 and 44 more clearly shown in the enlarged view FIG. 6. Wires 43 and 44 are individually connected to battery terminals 32 and 34.

Figure 7:
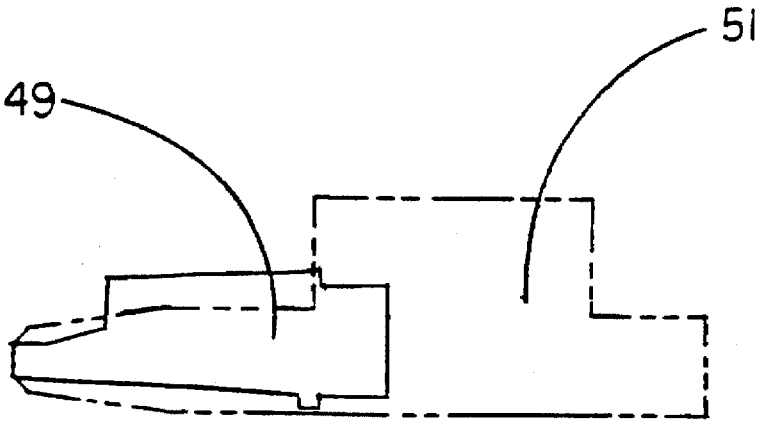
FIG. 7 is an outline view of the present invention heat exchanger structure compared to a phantom outline view of a typical comparably rated wattage glue gun heat exchanger structure.

In the prefered embodiment the formed heat-liquefiable material conductor and dispensing member 47 shown in FIG. 5 is a low volume thermal mass formed by a die-casting comprised of an efficient heat transfer material such as aluminum. The low volume size is graphically illustrated in FIG. 7 where an outline of the present invention heat exchanger structure 49 wherein wall thicknesses are controlled by design to provide good heat conductance with minimal thermal mass is compared to a phantom outline of a typical comparably rated wattage structure 51 currently found in many glue guns. A PTC barium titanate resistive heating element 42 with insulation 48 such as thin film Kapton, Mylar, thermally conductive silicon rubber sheet, or ceramic adhesive, etc., interposed are appropriately positioned contiguous to the outer wall surface of the material conductor and dispensing member 47. An insulating cover 50 formed from heat resistant material surrounds the dispensing outlet and resistive heating element. The term heat exchanger structure as used in the present invention comprises the heat-liquefiable material conductor and dispensing member 47, heating element 42, required insulation 48 and two contact plates 46 required to conduct electric power to the heating element 42.

While the heat exchanger structure is shown and described herein in the form of a PTC resistive heating element and heat-liquefiable material conductor, it is to be understood that other configurations may be accomplished with other forms of resistive heating elements placed in contiguous relationship to the outer wall of a low volume efficient heat transfer heat-liquefiable conductor to accomplish the same function within the scope of this invention. Most importantly, the term heat exchanger structure as used herein includes the limited volume thermal mass surrounding the adhesive material, effectively functioning as a thermal and adhesive conductor, in conjunction with the resistive electrical device positioned on the outer wall surface of the adhesive material conductor and dispenser. Heat is transferred rapidly through the low volume conductor and dispenser surrounding the heat-liquefiable material.

When the operator pulls trigger 22, the heating element 42 is energized and rapidly heats the material conductor and dispensing member 47, which is simultaneously pressed into direct contact with the heat-liquefiable material 12 thru guide tube 15 (See FIG. 5). As the material contacts the hot internal wall surfaces of the material conductor it liquefies in the general vicinity of the contact contact, developing a liquid interface between the solid stick 12 and the material conductor and dispensing member 47. Under pressure from the feeding mechanisim the melted material is urged toward the dispensing outlet 14 where it exits. In order to achieve the necessary melting temperature rapidly and efficiently to maintain reasonable battery life, the heat exchanger structure is constructed to have a low volume thermal mass and to achieve during warm-up, a sufficiently high watt density per unit volume. Particularly, during the warm-up period as the temperature of the heat exchanger structure and the heat-liquefiable material rises from below melting temperature to the melting temperature, average power consumption of the heat exchanger structure must be at least 125 watts per cubic inch of the heat exchanger structure volume. Additionally, the mass of the heat exchanger structure must be limited relative to the power consumption and its specific heat capacity as related to thermal conductance properties For example, for a die-cast aluminum heat exchanger structure design with a specific heat capacity of 0.22 BTU/lb/20 F., it has been determined that the ratio of mass of the heat exchanger structure to the average power consumption during warm-up must be less than 0.35 grams per watt. For a predominantly copper heat exchanger structure design with a specific heat capacity of 0.095 BTU/lb/° F., the ratio of the mass of the heat exchanger structure to the average power consumption during warm-up to the heat liquefication temperature must be less than 0.88 grams per watt. Within these constraints minimal energy is required for the heat exchanger structure of this invention to reach and hold the desired melting temperature, and this is achievable relatively quickly following energization. To achieve these desired parameters it has been deterimed that, by selecting materials with the proper heat transfer characteristics, the weight of the heating element heat exchanger structure is controlled by the following formula:

$$\text{Weight in Grams/Watt} = \frac{.303 - (\text{Heat Exchanger Structure Specific Heat Capacity In BTU/lb/°F.})}{.237},$$

Simultaneously, when trigger 22 is released, feeding of the adhesive material stops, switch 38 is opened and power to the heating element 42 ceases, and the heat exchanger structure quickly cools due to its low mass. When cooled sufficiently, the melted material within the tip solidifies. Subsequent application of power to the heating element quickly re-melts the material and the outlet again dispenses the liquid. Plugging of the dispensing outlet is avoided, in the embodiment shown in FIG. 5, by keeping the diameter and length of the opening 14 small enough and in close relation to heating element 42 to allow effective thermal conduction.

From the foregoing description, it will be apparent that modifications can be made to the apparatus and method for using same without departing from the teachings of the present invention. Accordingly, the scope of the invention is only to be limited as necessitated by the accompanying claims.

I claim:

1. In a device for heating and dispensing heat-liquefiable material of the type adapted to receive solid heat-liquefiable material, and to dispense liquefied material from the outlet thereto, including means for incrementally feeding said solid heat-liquefiable material into said device, the improvement comprising:

a low volume thermal mass heat exchanger structure comprised of a formed heat conductive material conductor and dispensing outlet with an electrical resistive heating element positioned in contiguous relationship to the outer wall surface of said conductor, said structure arranged to achieve direct contact with said heat-liquefiable material when fed into said device to liquefy and dispense the material when said heat exchanger structure is energized to an average volumetric watt density of at least 125 watts per cubic inch during warm-up to the heat-liquefication temperature, an operator control means comprised of a manually actuatable momentary on/off switch connected in the circuit to energize said heating element member of said heat exchanger structure and arranged to operate simultaneously with said means for incrementally feeding said solid-heat-liquefiable material, whereby actuation of said operator control means causes switch closure causing said heat exchanger structure to promptly melt and dispense said heat-liquefiable material and switch opening, allowing re-solidification of said material.

2. The device for heating and dispensing heat-liquefiable material of claim 1 wherein said heat exchanger structure is characterized by a ratio of mass to average power consumption during warm-up to the heat liquefication temperature of less than the grams per watt defined by the calculation:

$$\text{Weight in Grams/Watt} = \frac{.303 - (\text{Heat Exchanger Structure Specific Heat Capacity In BTU/lb/°F.})}{.237}.$$

3. The device for heating and dispensing heat-liquefiable material of claim 1 wherein the material for the said formed heat-liquefiable material conductor is comprised of efficient heat transfer material(s).

4. In a device for heating and dispensing heat-liquefiable material of the type adapted to receive solid heat-liquefiable material, and to dispense liquefied material from the outlet thereto, including means for incrementally feeding said solid heat-liquefiable material into said device, the improvement comprising:

an efficient low volume thermal heat transfer mass heat exchanger structure comprised of a formed heat conductive material conductor juxtaposed to a resistive heating means on the outer wall surface(s) of said heat-liquefiable material conductor, the structure arranged to achieve direct thermal contact with said heat-liquefiable material fed into said device to liquefy and dispense the material when said heat exchanger structure is characterized by a ratio of mass to average power consumption during warm-up to the heat-liquefication temperature of less than the grams per watt defined by the calculation:

$$\text{Weight in Grams/Watt} = \frac{.303 - (\text{Heat Exchanger Structure Specific Heat Capacity In BTU/lb/°F.})}{.237},$$

an operator control means comprised of a manually triggered, normally open, momentary on/off switch connected in a circuit to intermittently energize said heating element disposed in contiguous relationship to said heat exchanger structure and arranged to simultaneously apply pressure to means for incrementally feeding said heat-liquefiable material, whereby switch closure causes said heat exchanger structure to promptly melt and dispense said heat-liquefiable material and switch opening allowing re-solidification of said material.

5. The device for heating and dispensing heat-liquefiable material of claim 4 wherein said heating element structure develops an average watt density of at least 125 watts per cubic inch during warm-up to the heat liquefication temperature.

6. The device for heating and dispensing heat-liquefiable material of claim 4 wherein the material for the said heat-liquefiable material conductor is comprised of an efficient heat transfer material(s).

* * * * *